US007446730B2

(12) United States Patent
Yonemoto et al.

(10) Patent No.: US 7,446,730 B2
(45) Date of Patent: Nov. 4, 2008

(54) RADIO WAVE DEVICE

(75) Inventors: Naruto Yonemoto, Fuchu (JP); Motoharu Matsuzaki, Ota-ku (JP)

(73) Assignees: Electronic Navigation Research Institute, Tokyo (JP); Lenstar Co., Ltd, Tokyo (JP)

( * ) Notice: Subject to any disclaimer, the term of this patent is extended or adjusted under 35 U.S.C. 154(b) by 51 days.

(21) Appl. No.: 11/596,575

(22) PCT Filed: Mar. 9, 2005

(86) PCT No.: PCT/JP2005/004108

§ 371 (c)(1),
(2), (4) Date: Nov. 15, 2006

(87) PCT Pub. No.: WO2005/112189

PCT Pub. Date: Nov. 24, 2005

(65) Prior Publication Data

US 2007/0252776 A1 Nov. 1, 2007

(30) Foreign Application Priority Data

May 18, 2004 (JP) ..... 2004-148359

(51) Int. Cl.
*H01Q 1/42* (2006.01)

(52) U.S. Cl. ..... 343/872; 343/705; 343/708

(58) Field of Classification Search ..... 343/872, 343/705, 708
See application file for complete search history.

(56) References Cited

U.S. PATENT DOCUMENTS 4,980,696 A * 12/1990 Stone et al. ..... 343/872
5,384,458 A * 1/1995 Hilliard et al. ..... 250/227.17
5,661,498 A * 8/1997 Goto et al. ..... 343/771

FOREIGN PATENT DOCUMENTS

| | | | |
|---|---|---|---|
| JP | 50-116259 | A | 9/1975 |
| JP | 60-149223 | U | 10/1985 |
| JP | 61-128808 | U | 8/1986 |
| JP | 4-19815 | U | 2/1992 |
| JP | 5-48415 | U | 6/1993 |
| JP | 2001-102857 | | 4/2001 |
| JP | 2003-229712 | A | 8/2003 |

* cited by examiner

*Primary Examiner*—Hoang V Nguyen
(74) *Attorney, Agent, or Firm*—Bacon & Thomas PLLC

(57) ABSTRACT

In the case of the electromagnetic waves of a band with a short wavelength, in an antenna opening, the technical subject which conflicts between loss of electromagnetic waves and the mechanical strength of a member exists. This invention was made in view of such a problem, and aims at offering a radome with little cover of electromagnetic waves, absorption of electromagnetic waves, and dispersion of electromagnetic waves by the member of a radome. It aims at offering a strong and lightweight radome cheaply.

25 Claims, 13 Drawing Sheets

RADIO WAVE DEVICE

FIELD OF THE INVENTION

This invention relates to the radio wave apparatus provided with the housing for protection for protecting the radio wave device which receives or reflects an radio wave.

BACKGROUND OF THE INVENTION

Generally, the mechanical reinforcement to external factors, such as a rainstorm, of the radar antenna currently installed out in the fields is inadequate. However, a part for an antenna element section is used in the state where it exposed. As the reason, in order to protect a part for an antenna element section from breakage by external factors, such as a rainstorm, and Since mechanical strength of an antenna is increased, when a reinforcing member for reinforcing a part for an antenna element section is attached to a part for an antenna element section, it is for radio wave loss to arise on a radio wave which enters into an antenna, and for the directivity of an antenna to deteriorate by this reinforcing member.

Then, in order to protect antenna elements, such as a radar, the radome with which the whole antenna is covered is used. This radome is formed in the shape of a globular form, a cylinder type, a rectangular parallelepiped form, etc. by a skeleton member. The surface of this skeleton member is covered with surface protection material, and is protected. Generally, as surface protection material, dielectric plates, such as FRP (fiber reinforced plastics and the following describe it as FRP) which is radio wave penetration material, are used. As for the skeleton member of the radome, aggregate or metal is used.

Aggregate is manufactured with the dielectrics which have the same character as FRP. As an antenna device which uses the sphere lens represented by the Luneberg lens, there is antenna device 111 shown in FIG. 13. Antenna device 111 consists of sphere lens 114, radome 133, and foam material layer 134. Foam material layer 134 is filled up with a foam material between sphere lens 114 and radome 133, and is formed in it. This foam material layer 134 has combined sphere lens 114 and radome 133. Sphere lens 114 is held by foam material layer 134 in radome 133.

[Patent documents 1]

JP, 2001-102857, A

DESCRIPTION OF THE INVENTION

[Problem(s) to be Solved by the Invention]

In the case of a radio wave of a band whose wavelength is shorter than a millimeter wave band (frequency of 30-300 GHz), cover of a radio wave, absorption of a radio wave, dispersion of a radio wave, etc. occur by a skeleton member which constitutes a radome. Therefore, there is a fault that loss of a radio wave which enters into an antenna arranged in a radome increases.

In order to suppress loss of a radio wave in the case of a radio wave whose wavelength is shorter than a millimeter wave band (frequency of 30-300 GHz), it is necessary to form surface protection material thinly in an opening of an antenna. When a large material of dielectric loss is used as surface protection material, it is necessary to form surface protection material still more thinly. Therefore, the fault of weakening mechanical strength of a radome arises. There is a radome which used materials, such as the TEFLON (registered trademark) with little loss, as a skeleton member in a millimeter wave band. Since the dielectrics used as the material of these skeleton members have high weight density, when such a skeleton member is used, there is a fault when a radome becomes very heavy.

On the other hand, it is considered as the surface protection material of radome 133 or a general radome shown in FIG. 13, and FRP is used. Such an FRP is lightweight and strong to tension, bending, compression, etc. Therefore, although FRP has the performance which was excellent as structure material, there are the following faults. That is, in the manufacturing process of FRP, roughness and fineness occur on the glass fiber which is one of the compositions of PRF. By the roughness and fineness of this glass fiber, the situation where the dielectric constant between resin and the glass fiber which are all one of the compositions of FRP is different occurs. FRP has many manufacturing processes and a manufacturing cost becomes high.

A difference of a dielectric constant of each composition which constitutes FRP will generate the following problems by a radio wave of a band where a wavelength is shorter than a millimeter wave band (frequency of 30-300 GHz). That is, dispersion and radio wave loss of a radio wave which enters into an antenna arranged in a radome increase still more remarkably. Moreover, it is difficult to obtain like FRP surface protection material which serves as composition with the whole uniform surface of a radome. The beam characteristics of an entering radio wave differ depending on frequency.

In the case of a radio wave of a band whose wavelength is shorter than a millimeter wave band (frequency of 30-300 GHz), radio wave loss of styrene foam currently used for foam material layer 134 shown in FIG. 13 increases.

As mentioned above, in the case of a radio wave of a band with a short wavelength, in an antenna opening, a technical subject which conflicts between loss of a radio wave and mechanical strength of a member exists. This invention was made in view of such a problem, and offers a radome with little cover of a radio wave, absorption of a radio wave, and dispersion of a radio wave by the member of a radome. A strong and lightweight radome is offered cheaply.

[Means for Solving the Problem]

In radio wave apparatus which consists of housing for protection which protects radio wave device arranged inside, and radio wave device arranged inside this housing for protection, the housing for protection concerning claim 1 consists of the styrene foam structure and a dielectric thin film, forming styrene foam structure in the circumference of a radio wave device with styrene foam, this styrene foam has the specific inductive capacity which is transparent to a radio wave, the dielectric thin film is surrounding the surface of styrene foam structure, and is formed thinly enough compared with high hardness and a wavelength.

In radio wave apparatus which consists of housing for protection which protects the radio wave device arranged inside, and a radio wave device arranged inside this housing for protection, the housing for protection concerning claim 2 consists of styrene foam structure and a dielectric thin film, forming styrene foam structure in the circumference of a radio wave device with styrene foam, this styrene foam has the specific inductive capacity which is transparent to a radio wave, the dielectric thin film is surrounding the surface of styrene foam structure, and it is formed thinly enough compared with high hardness and a wavelength, and the styrene foam structure is enclosed where styrene foam is stuck to the circumference of radio wave device.

In the radio wave apparatus which consists of housing for protection which protects the radio wave device arranged inside, and a radio wave device arranged inside this housing for protection, the housing for protection concerning claim 3 consists of styrene foam structure and a dielectric thin film, forming styrene foam structure in the circumference of a radio wave device with styrene foam, this styrene foam has the specific inductive capacity which is transparent to a radio wave, the dielectric thin film is surrounding the surface of styrene foam structure, and it is formed thinly enough compared with high hardness and a wavelength, and the radio wave device arranged inside the housing for protection is an antenna. In radio wave apparatus which consists of housing for protection which protects the radio wave device arranged inside, and a radio wave device arranged inside this housing for protection, the housing for protection concerning claim 4 consists of styrene foam structure and a dielectric thin film, forming styrene foam structure in the circumference of a radio wave device with styrene foam, this styrene foam has the specific inductive capacity which is transparent to a radio wave, the dielectric thin film is surrounding the surface of styrene foam structure, and it is formed thinly enough compared with high hardness and a wavelength, and the styrene foam structure is enclosed where styrene foam is stuck to the circumference of a radio wave device, and the radio wave device arranged inside the housing for protection is an antenna.

In radio wave apparatus which consists of housing for protection which protects the radio wave device arranged inside, and a radio wave device arranged inside this housing for protection, the housing for protection concerning claim 5 consists of styrene foam structure and a dielectric thin film, forming styrene foam structure in the circumference of a radio wave device with styrene foam, this styrene foam has the specific inductive capacity which is transparent to a radio wave, the dielectric thin film is surrounding the surface of styrene foam structure, and it is formed thinly enough compared with high hardness and a wavelength, the radio wave device is a spherical dielectrics electromagnetic lens, the styrene foam structure covers the surface of a dielectrics electromagnetic lens, and has a radius equal to a focal length of this dielectrics electromagnetic lens, and the styrene foam structure is enclosed where styrene foam is stuck to the circumference of an radio wave device.

In radio wave apparatus which consists of housing for protection which protects an radio wave device arranged inside, and an radio wave device arranged inside this housing for protection, the housing for protection concerning claim 6 consists of styrene foam structure and a dielectric thin film, forming styrene foam structure in the circumference of a radio wave device with styrene foam, this styrene foam has the specific inductive capacity which is transparent to a radio wave, the dielectric thin film is surrounding the surface of styrene foam structure, and it is formed thinly enough compared with high hardness and a wavelength, the radio wave device is a spherical dielectrics electromagnetic lens, the styrene foam structure covers the surface of a dielectrics electromagnetic lens, and has a radius equal to a focal length of this dielectrics electromagnetic lens, the styrene foam structure is enclosed where styrene foam is stuck to the circumference of an radio wave device, and the radio wave reflector which reflects a radio wave is formed in the surface of styrene foam structure.

In radio wave apparatus which consists of housing for protection which protects the radio wave device arranged inside, and a radio wave device arranged inside this housing for protection, the housing for protection concerning claim 7 consists of styrene foam structure and a dielectric thin film, forming styrene foam structure in the circumference of a radio wave device with styrene foam, this styrene foam has the specific inductive capacity which is transparent to a radio wave, the dielectric thin film is surrounding the surface of styrene foam structure, and it is formed thinly enough compared with high hardness and a wavelength, the radio wave device is a spherical dielectrics electromagnetic lens, the styrene foam structure covers the surface of a dielectrics electromagnetic lens, and has a radius equal to a focal length of this dielectrics electromagnetic lens, the styrene foam structure is enclosed where styrene foam is stuck to the circumference of an radio wave device, and the radio wave receive section which receives with a spherical dielectrics electromagnetic lens is formed in the surface of styrene foam structure.

In the invention concerning claim 1-claim 7, the dielectric thin film concerning claim 8 is a dielectrics paint film which coats resin. In the invention concerning claim 1-claim 7, the foaming rate of the styrene foam of the styrene foam structure concerning claim 9 is 20 or more times, and the thickness of a dielectrics paint film is 2 mm or less. In the invention concerning claim 1-claim 7, the invention concerning claim 10 uses urethane foam instead of the styrene foam of styrene foam structure.

In the invention concerning claim 1-claim 7, the dielectric thin film concerning claim 11 is a dielectrics paint film which coats resin, the foaming rate of the styrene foam of styrene foam structure is 20 or more times, and the thickness of a dielectrics paint film is 2 mm or less. In the invention concerning claim 1-claim 7, the dielectric thin film concerning claim 12 is a dielectrics paint film which coats resin, urethane foam is used instead of the styrene foam of styrene foam structure. In the invention concerning claim 1-claim 7, urethane foam is used for the styrene foam structure concerning claim 13 instead of styrene foam, and the foaming rate of urethane foam is 20 or more times, and the thickness of a dielectrics paint film is 2 mm or less.

In the invention concerning claim 1-claim 7, the dielectric thin film concerning claim 14 is a dielectrics paint film which coats resin, urethane foam is used instead of the styrene foam of styrene foam structure, the foaming rate of urethane foam is 20 or more times, and the thickness of a dielectrics paint film is 2 mm or less.

[Effect of the Invention]

Since the invention concerning claim 1 was performed above, mechanical modification of the bend produced from external factors, such as a rainstorm, or the sudden phenomenon under measurement does not generate the radio wave device arranged inside the housing for protection. There is little influence about cover of a radio wave, absorption of a radio wave, and dispersion of a radio wave generated by the housing for protection, and it is strong and lightweight. Styrene foam structure is since the styrene foam which has the specific inductive capacity which is transparent to a radio wave was used, the dielectric thin film can be formed thinly enough compared with a wavelength, and the housing for protection can be formed in any shape.

Since the circumference of the radio wave device arranged inside the housing for protection of the invention concerning claim 2 is held at the state where it stuck with styrene foam, The invention concerning claim 2 has an effect of the invention concerning claim 1, and can hold a radio wave device in the state where it fixed strongly inside. The radio wave device in the housing for protection is since it does not move within the housing for protection to vibration by the case where it carries, an earthquake, etc., and destruction, damage, mechanical modification, etc. do not occur to a radio wave device.

Also in the case of form which the antenna arranged inside the housing for protection rotates like the parabolic antenna of a radar, since the invention concerning claim 3 was performed above, there is the same effect as claim 1. Since the invention concerning claim 4 was performed above, When the antenna arranged inside the housing for protection is a bar antenna like a dipole antenna, the circumference of an antenna is in the state stuck with styrene foam. Therefore, the invention concerning claim 4 has an effect according to claim 2, and further, the antenna can maintain weather resistance while being able to maintain high strength also to a local load.

Since the invention concerning claim 5 was performed above, the surface of the dielectrics electromagnetic lens arranged inside the housing for protection is damaged according to neither external factors, such as a rainstorm, nor the sudden phenomenon under measurement. Mechanical modification of the housing for protection does not occur. Therefore, since the distortion as an electromagnetic lens to an incidence radio wave does not occur, there is the same effect as claim 2. The focal length to an incidence radio wave is not changed. There is little influence about cover of a radio wave, absorption of a radio wave, and dispersion of a radio wave generated by the housing for protection, and it is strong and lightweight.

Since the invention concerning claim 6 was performed above, the radio wave reflecting device as a radio wave device arranged inside the housing for protection is obtained. The dielectrics electromagnetic lens of this radio wave reflecting device is protected by the styrene foam structure and the dielectric thin film which constitute the housing for protection. The radio wave reflector of this radio wave reflecting device is protected by the dielectric thin film of the housing for protection. Therefore, the same effect as claim 2 and claim 5 is acquired.

Since the invention concerning claim 7 was performed above, the styrene foam structure and a dielectrics electromagnetic lens can be used as a Luneberg lens which has the same characteristic as all the directions. The radio wave which entered into the radio wave receive section is receivable.

The dielectric thin film of the invention concerning claim 8-claim 14 is a dielectrics paint film which coated resin, The foaming rate of the styrene foam of styrene foam structure is 20 or more times, the thickness of a dielectrics paint film is 2 mm or less, and there is the same effect as claim 1 and claim 2. The radio wave apparatus provided with the strong and lightweight housing for protection is obtained that there are little the cover of a radio wave, the absorption of a radio wave, and the influence of dispersion of a radio wave which are generated by the housing for protection.

BRIEF DESCRIPTION OF THE DRAWINGS

[Drawing 1]

[Drawing 2]

Figure 2:
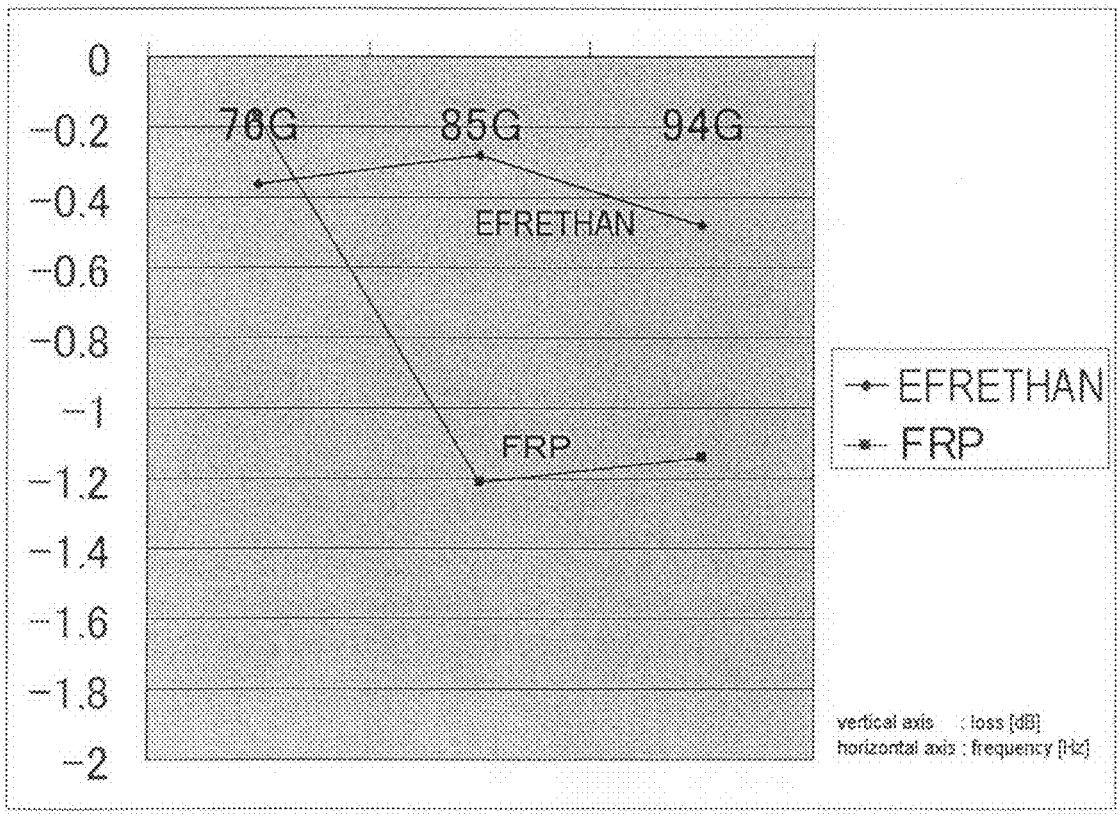

FIG. 2 shows this example of working of an invention, when the material currently used with dielectric thin film 5 is a EFRETHANE or FRP, it is a characteristic figure showing the relation between loss and frequency.

[Drawing 3]

Figure 3:
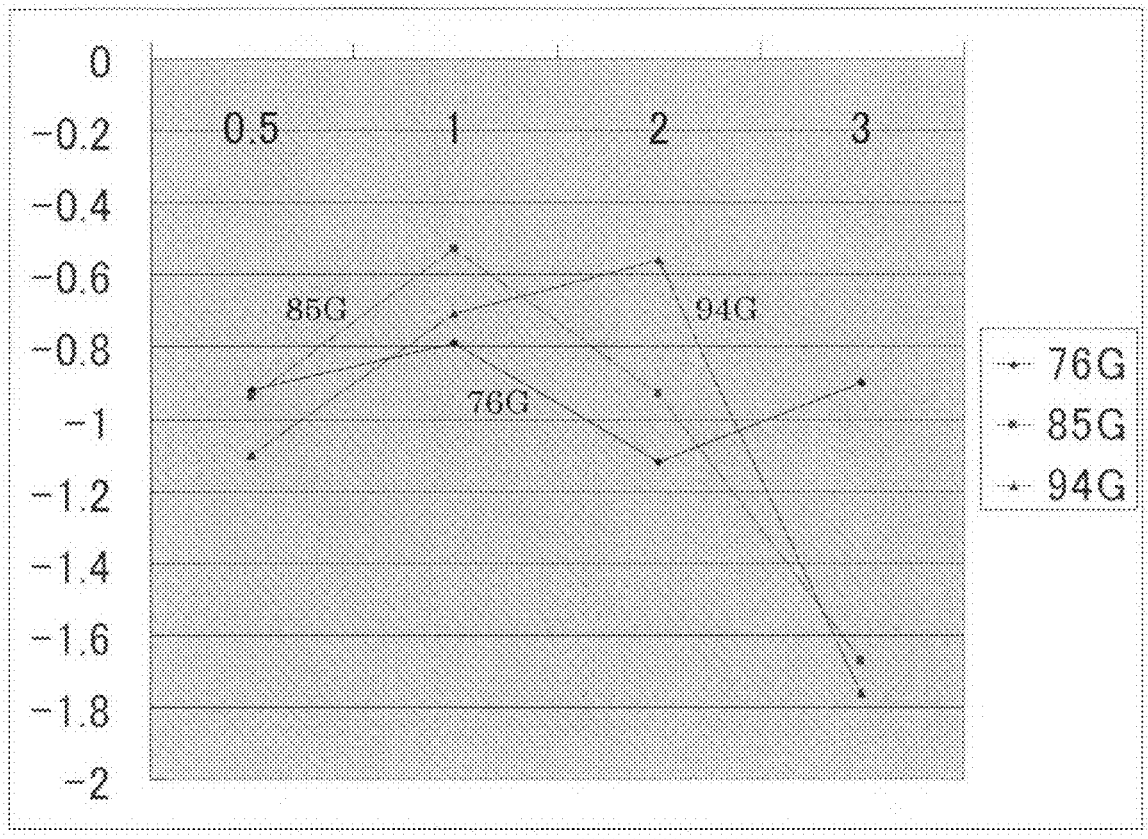

FIG. 3 shows this example of working of an invention, frequency is made into a parameter, and when the foaming rate of the styrene foam of styrene foam structure 4 is 20, it is a characteristic figure showing the relation of the thickness and loss of dielectric thin film 5.

[Drawing 4]

Figure 4:
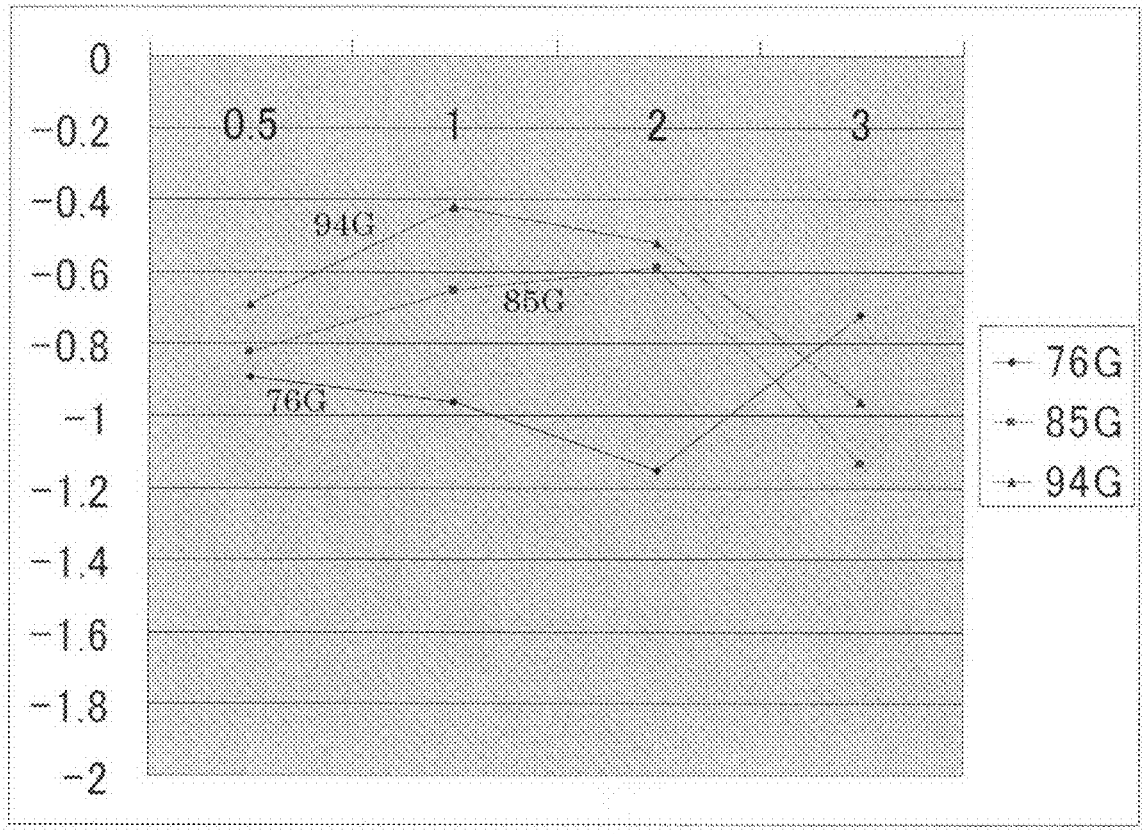

FIG. 4 shows this example of working of an invention, Frequency is made into a parameter, and when the foaming rate of the styrene foam of styrene foam structure 4 is 30, it is a characteristic figure showing the thickness and the relation of loss of dielectric thin film 5.

[Drawing 5]

Figure 5:
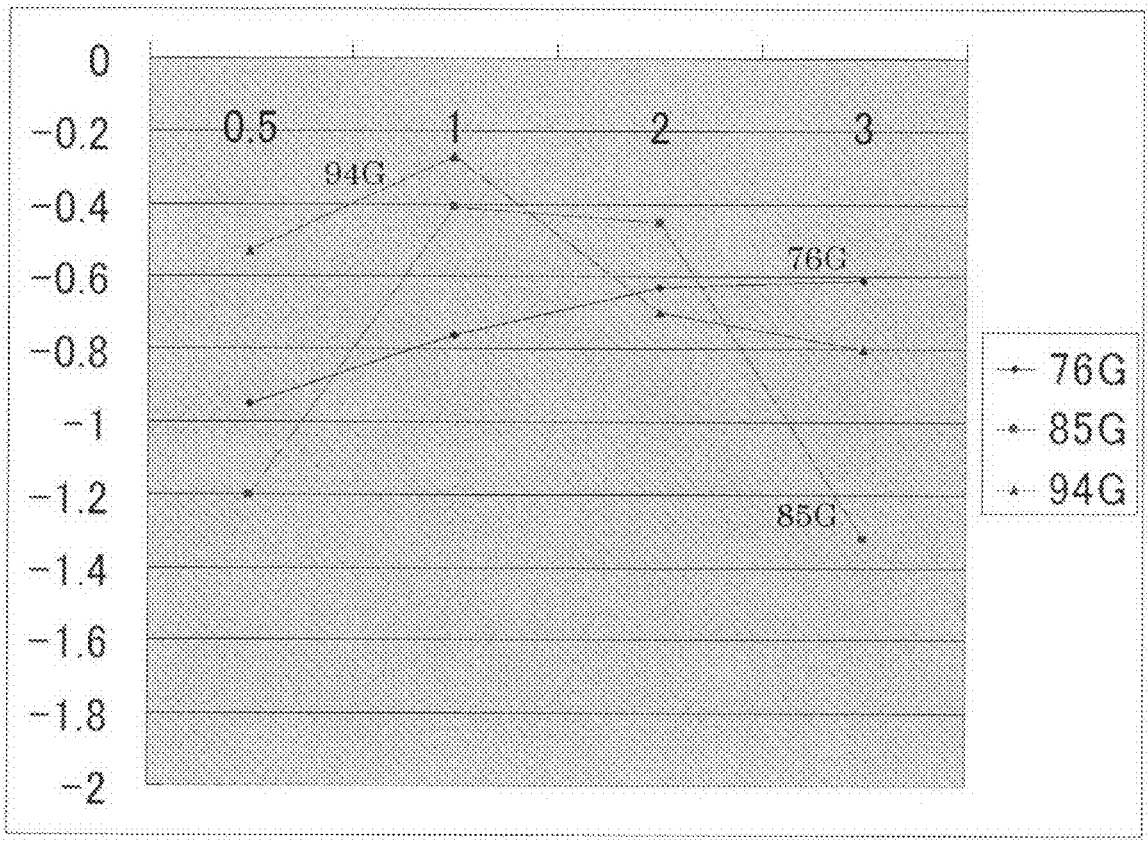

FIG. 5 shows this example of working of an invention, Frequency is made into a parameter, and when the foaming rate of the styrene foam of styrene foam structure 4 is 40, it is a characteristic figure showing the relation of the thickness and loss of dielectric thin film 5.

[Drawing 6]

Figure 6:
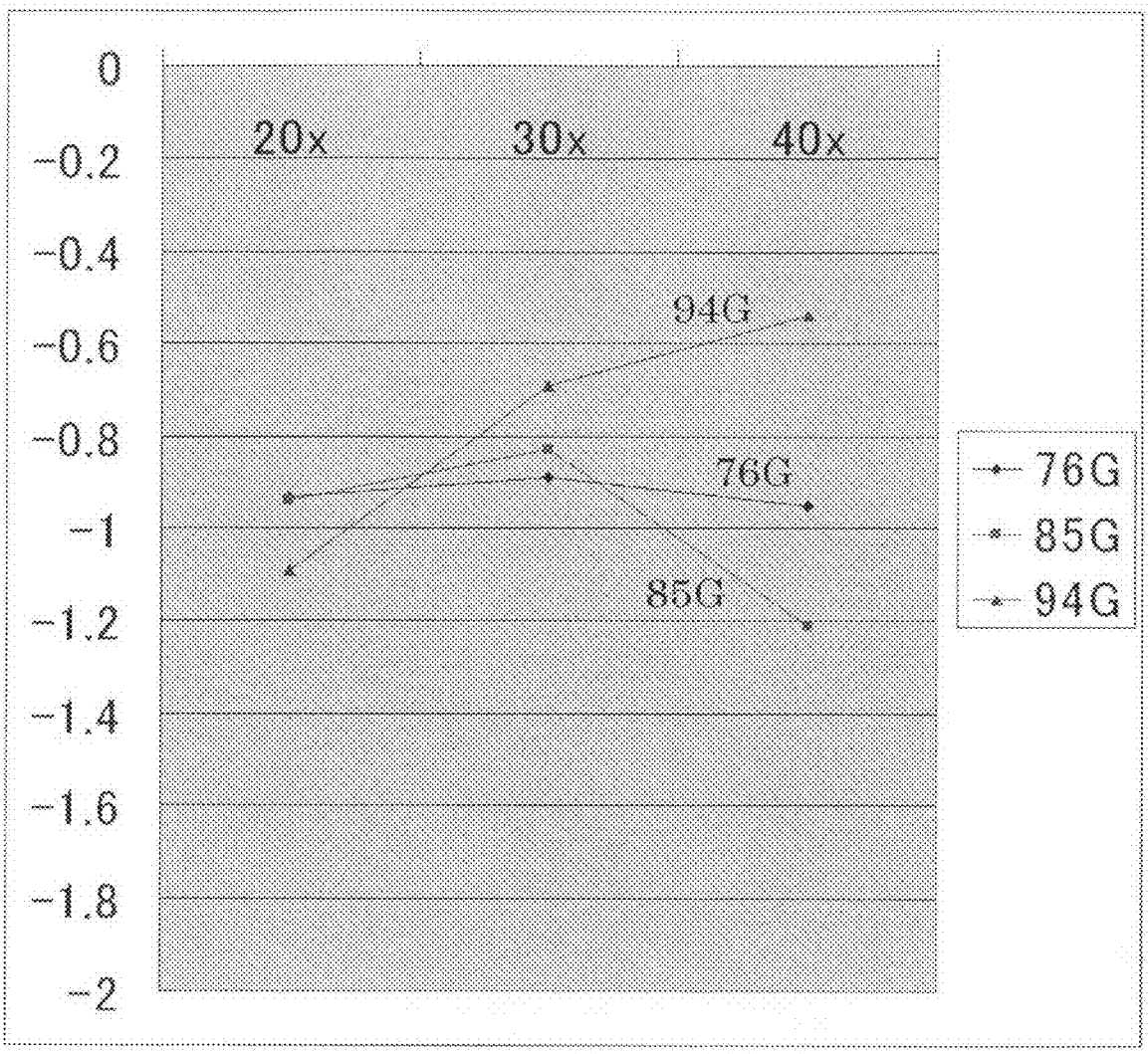

FIG. 6 shows this example of working of an invention, frequency is made into a parameter, and when the thickness of dielectric thin film 5 is 0.5 mm, it is a characteristic figure showing the relation of the foaming rate and loss of the styrene foam of styrene foam structure 4.

[Drawing 7]

Figure 7:
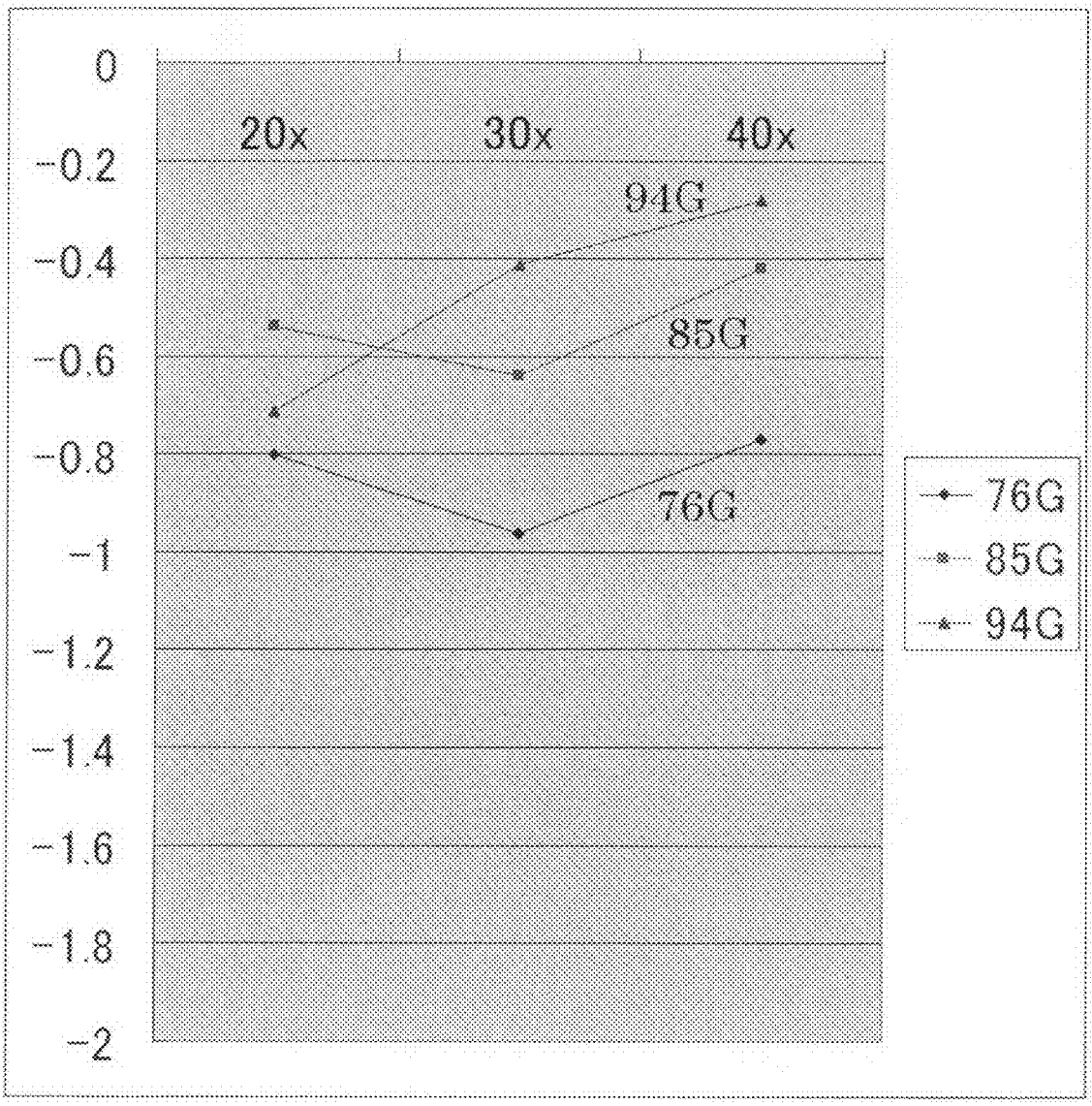

FIG. 7 shows this example of working of an invention, frequency is made into a parameter, and when the thickness of dielectric thin film 5 is 1 mm, it is a characteristic figure showing the relation of the foaming rate and loss of the styrene foam of styrene foam structure 4.

[Drawing 8]

Figure 8:
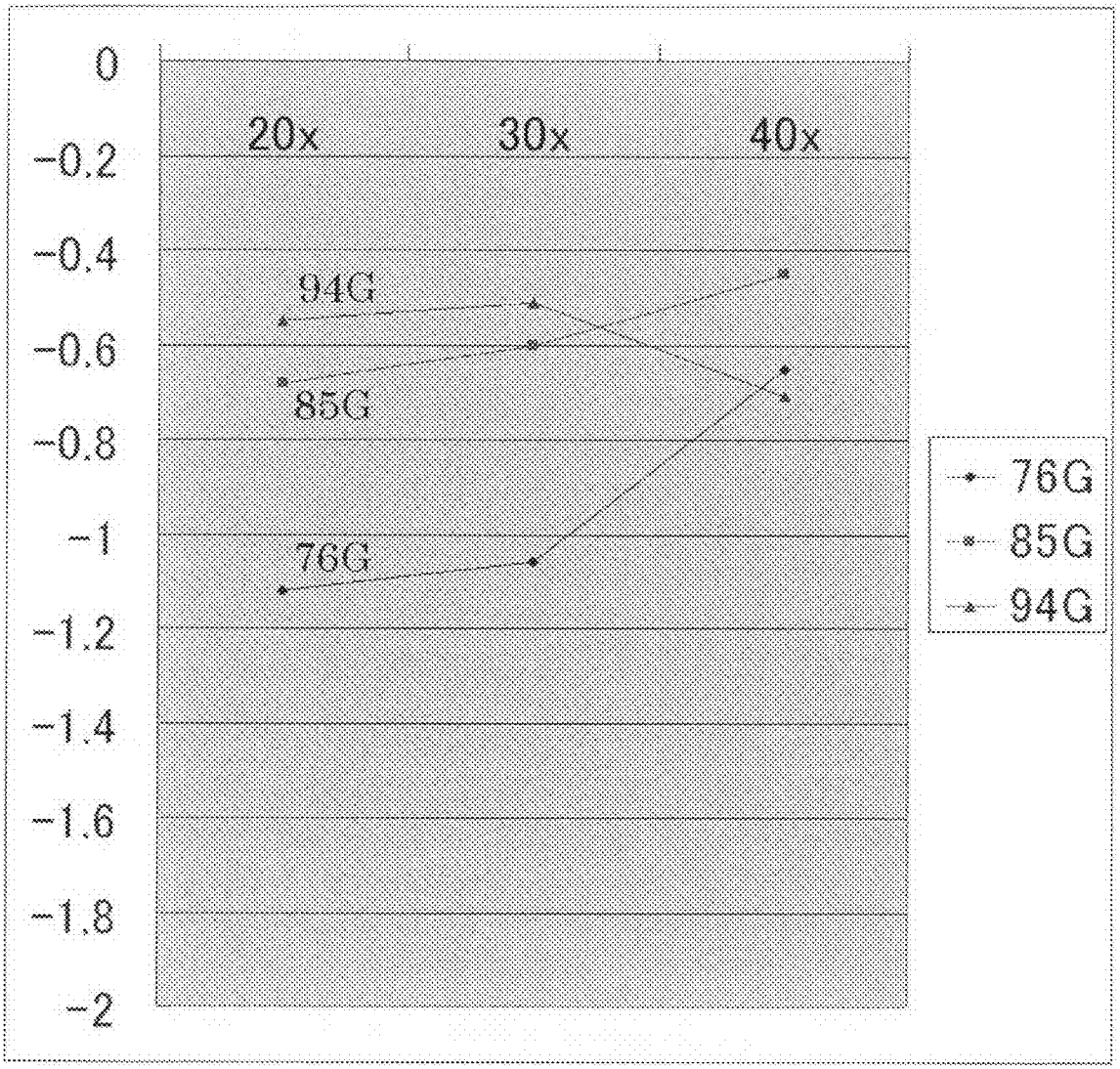

FIG. 8 shows this example of working of an invention, frequency is made into a parameter, and when the thickness of dielectric thin film 5 is 2 mm, it is a characteristic figure showing the relation of the foaming rate and loss of the styrene foam of styrene foam structure 4.

[Drawing 9]

Figure 9:
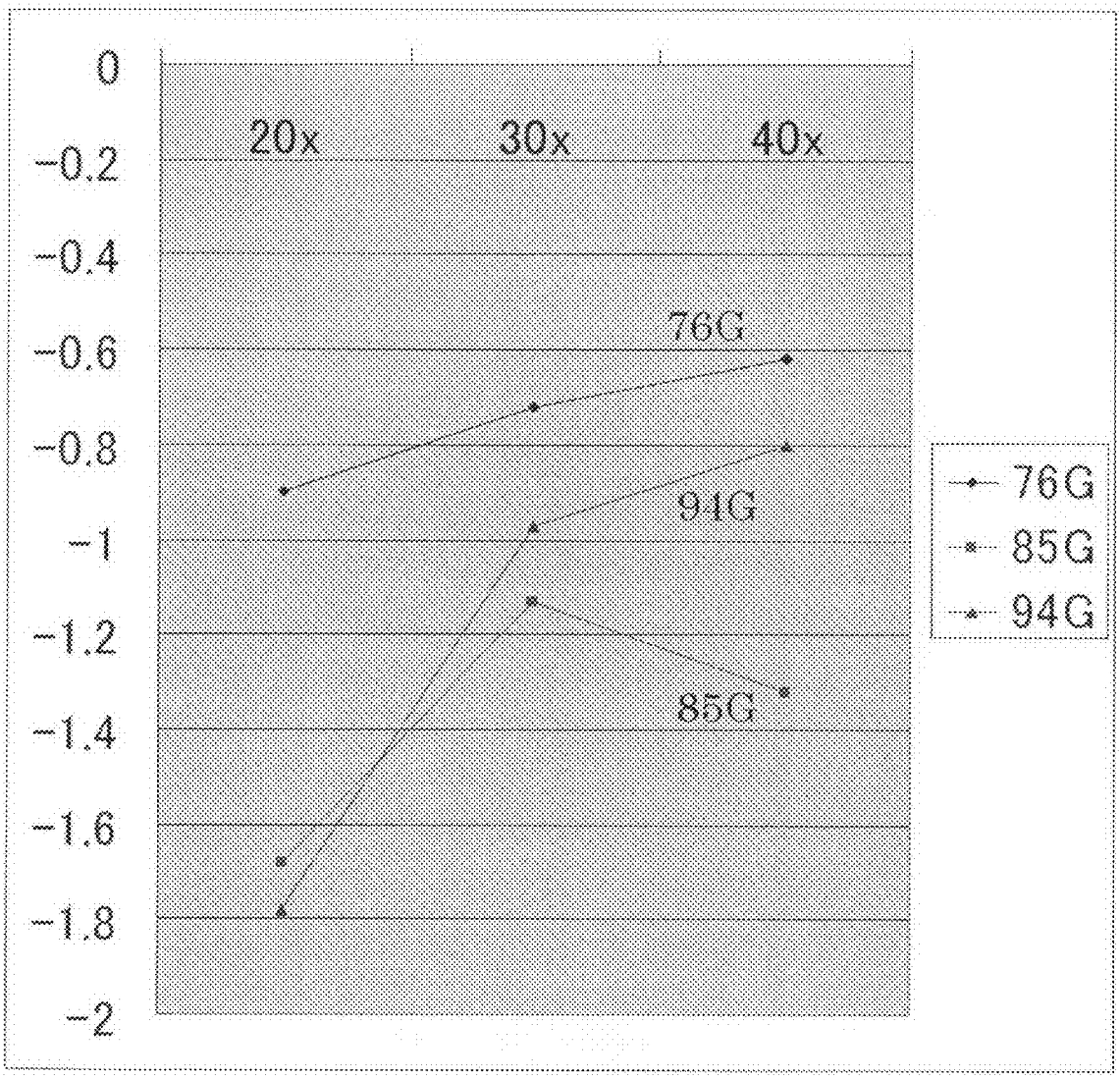

FIG. 9 shows this example of working of an invention, frequency is made into a parameter, and when the thickness of dielectric thin film 5 is 3 mm, it is a characteristic figure showing the relation of the foaming rate and loss of the styrene foam of styrene foam structure 4.

[Drawing 10]

Figure 10:
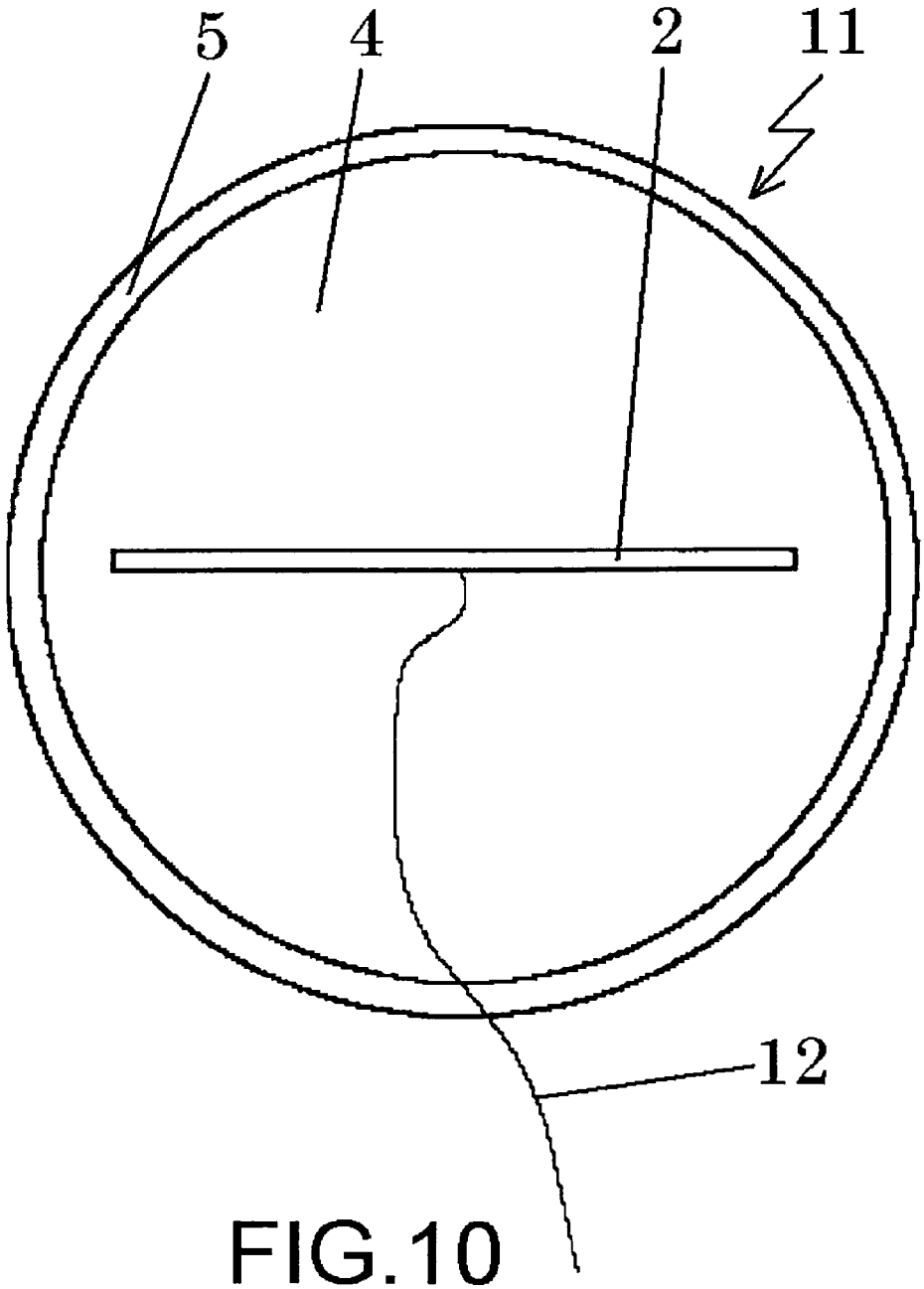

FIG. 10 shows the 2nd embodiment of this invention, it is a mimetic diagram showing the radio wave device arranged inside housing for protection 11, and this housing for protection.

[Drawing 11]

Figure 11:
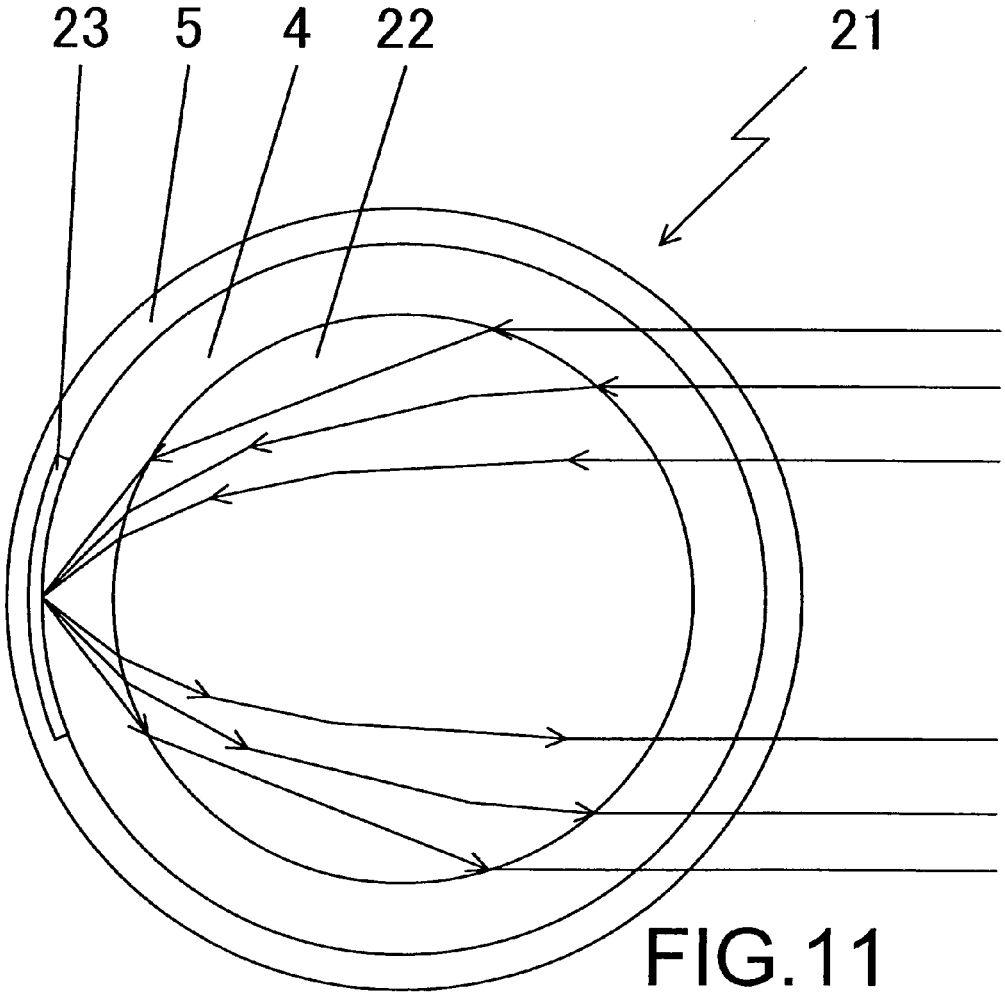

FIG. 11 is a mimetic diagram in which showing the 3rd embodiment of this invention, and showing housing for protection 21 and the radio wave device arranged to that inside.

[Drawing 12]

Figure 12:
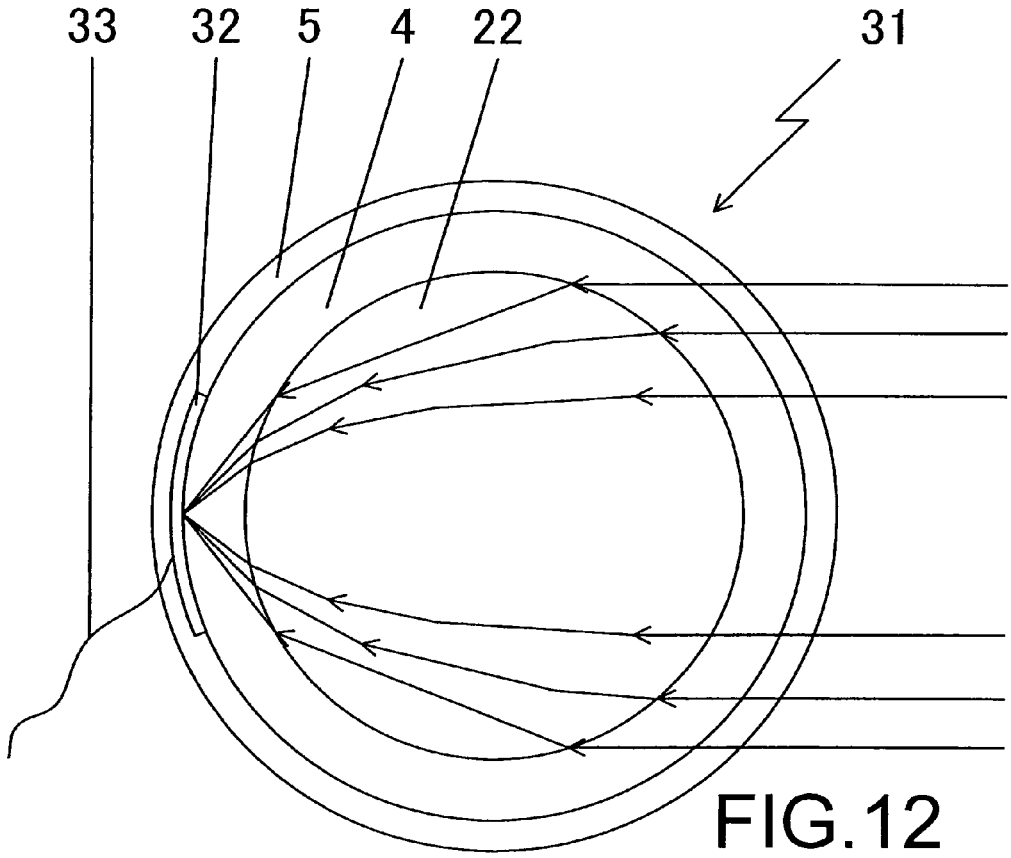

FIG. 12 is a mimetic diagram in which showing the 4th embodiment of this invention, and showing the radio wave device arranged inside housing for protection 31 and this housing for protection 31.

[Drawing 13]

Figure 13:
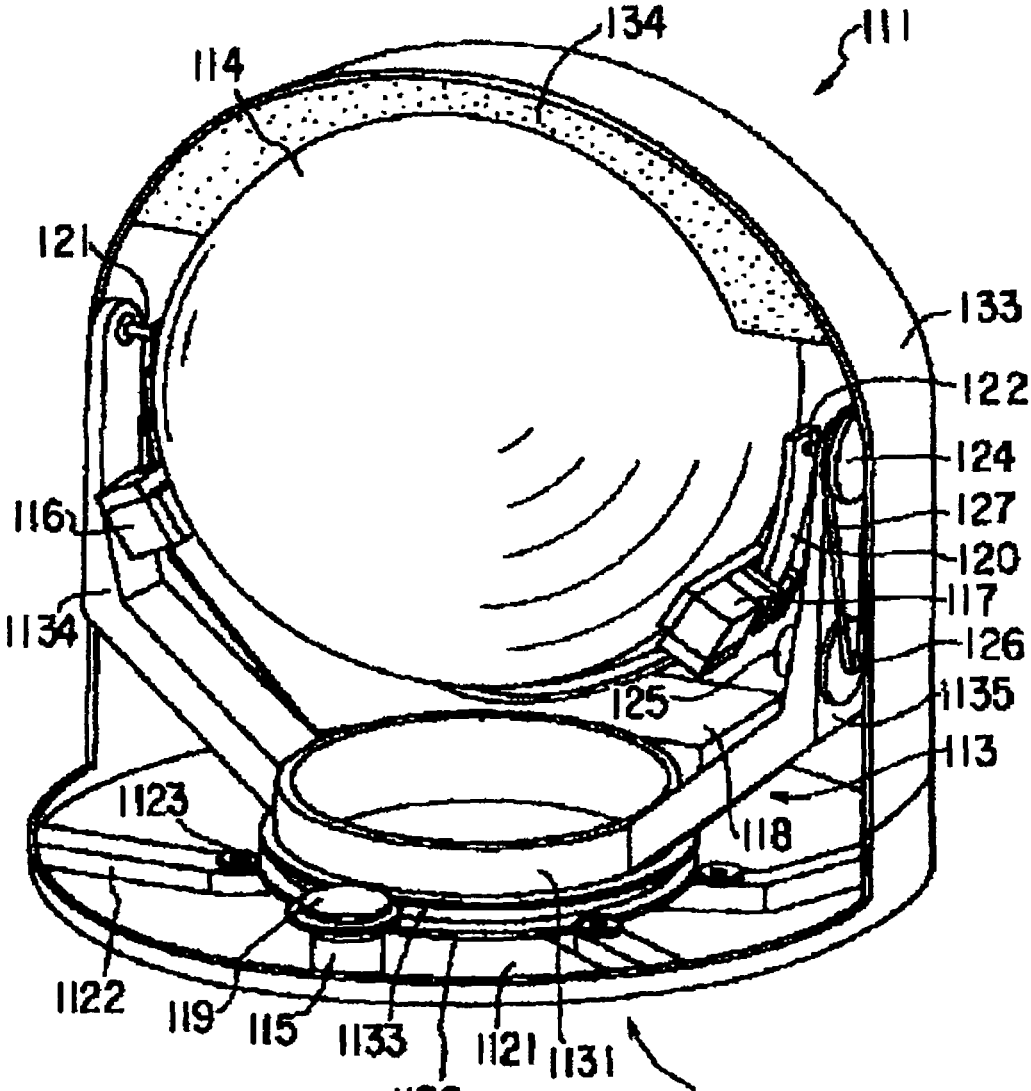

FIG. 13 is a perspective view showing the embodiment of the conventional antenna device.

| [Description of Notations] | |
|---|---|
| 1, 11, 21, and 31 | Housing for protection |
| 2 | Antenna |
| 3 | Antenna Support Rod |
| 4 | Styrene Foam Structure |
| 5 | Dielectric Thin Film |
| 12, 33 | Feeder |
| 22 | Dielectrics Electromagnetic Lens |
| 23 | Radio Wave Reflector |
| 32 | Radio Wave Receive Section |

BEST MODE FOR CARRYING OUT THE INVENTION

In the radio wave apparatus which consists of housing for protection which protects the radio wave device arranged inside, and a radio wave device like an antenna or a dielectrics electromagnetic lens arranged inside this housing for protection, The housing for protection consists of styrene foam structure and a dielectric thin film, forming styrene foam structure in the circumference of a radio wave device with styrene foam, this styrene foam has the specific inductive capacity which is transparent to a radio wave, the dielectric thin film is surrounding the surface of styrene foam structure, and is formed thinly enough compared with high hardness and a wavelength. A dielectric thin film is a dielectrics paint film which coated resin, the foaming rate of styrene foam is 20 or more times, and the thickness of a dielectrics paint film is 2 mm or less.

EMBODIMENT 1

Figure 1:
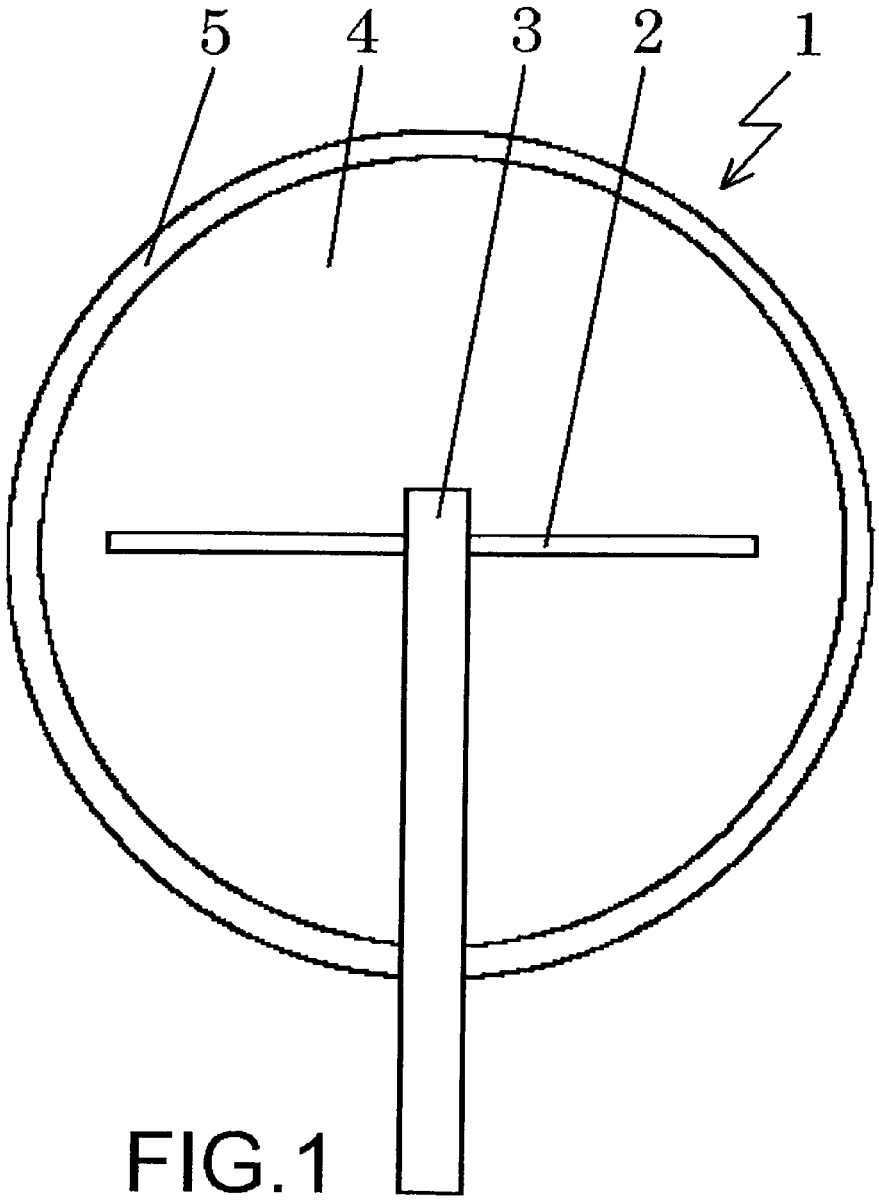
FIG. 1 is a mimetic diagram showing the 1st embodiment of this invention, the radio wave device arranged inside housing for protection 1 and this housing for protection is shown.

The 1st embodiment of this invention is explained in detail based on FIGS. 1-9. FIGS. 1-9 show the 1st embodiment of this invention. FIG. 1 is a mimetic diagram showing the radio wave device arranged inside housing for protection 1 and this housing for protection. FIG. 2 is a characteristic figure showing the relation between loss and frequency, when the material currently used for dielectric thin film 5 is a EFRETHANE or FRP. It is a characteristic figure in which FIGS. 3-5 making frequency a parameter, and showing the relation of the thickness and loss of dielectric thin film 5, FIG. 3 shows the time of the foaming rate of the styrene foam of styrene foam structure 4 being 20, FIG. 4 shows the time of the foaming rate of the styrene foam of styrene foam structure 4 being 30, and FIG. 5 shows the time of the foaming rate of the styrene foam of styrene foam structure 4 being 40.

It is a characteristic figure in which FIGS. 6-9 making frequency a parameter, and showing the relation of the foaming rate and loss of the styrene foam of styrene foam structure 4, FIG. 6 shows the time of the thickness of dielectric thin film 5 being 0.5 mm, FIG. 7 shows the time of the thickness of dielectric thin film 5 being 1 mm, FIG. 8 shows the time of the thickness of dielectric thin film 5 being 2 mm, and FIG. 9 shows the time of the thickness of dielectric thin film 5 being 3 mm.

In the case of the radome which uses the conventional FRP, in the millimeter wave band used by a radar etc., radio wave loss increases remarkably. Then, the inventor etc. performed investigation examination about various dielectric materials, in order to find out the dielectric material which there is sufficient mechanical strength to protect an antenna, and was suitable as a protect member of an antenna with little radio wave loss, even if it uses it in a millimeter wave band.

First, the inventor etc. noted using styrene foam lightweight as a protect member of an antenna collectively. Then, the housing for protection for protecting an antenna was formed with styrene foam, and the circumference of this housing for protection formed the thin film by protect members other than styrene foam. Thus, the inventor etc. tried the weight saving of the protect member, giving mechanical strength to the housing for protection. However, the problem that the radio wave loss in a millimeter wave band became large occurred with the foaming rate of styrene foam.

Then, in order to reduce the radio wave loss in a millimeter wave band, resin etc. is used as protect members other than styrene foam, and coating of the styrene foam surface is carried out with this resin etc., styrene foam, resin, etc. tended to be stuck and it was going to form the housing for protection. However, when the resin currently generally used was coated to the styrene foam surface, the styrene foam itself melted and it was not able to be used as housing for protection.

As a result of advancing further investigation examination, the inventor etc. found out the following matter. That is, the styrene foam (EPS) with a high foaming rate is still lighterweight than common styrene foam, and excellent in heat resistance. The inventor etc. found out the EFRETHANE (registered trademark) which is a kind of non-solvent urethane resin which is resin for coating. The EFRETHANE which is resin for these coating has the high hardness of a dryness state, is tough, and excellent in shock resistance and wear resistance. While this resin was able to carry out coating to styrene foam, it became clear by carrying out coating that styrene foam could be reinforced effectively. Then, in order to judge the character over the radio wave of resin for these coating, the inventor etc. experimented in many things. As a result, it became clear that the styrene foam whose foaming rate is higher than common styrene foam had specific inductive capacity close to 1, and it has the character which is transparent in radio wave.

Then, the inventor etc. made housing for protection 1 as an experiment using the styrene foam by which coating was carried out by the EFRETHANE. In FIG. 1, the radio wave device arranged in housing for protection 1 is constituted by antenna support rod 3 which supports antenna 2 and this antenna 2. In this embodiment, antenna 2 is a dipole antenna and the rod object of the metal of the length equivalent to one half of the wavelengths of the radio wave which enters into antenna 2 is used as an antenna 2. This antenna 2 is supported with antenna support rod 3. Electric power is supplied by antenna 2 via the feeder (not shown) which has penetrated the inside of antenna support rod 3.

Housing for protection 1 is constituted by styrene foam structure 4 and dielectric thin film 5. Inside styrene foam structure 4, the radio wave device constituted with antenna 2 and antenna support rod 3 is arranged. The styrene foam which has the specific inductive capacity which is transparent to a radio wave is enclosed with the circumference of the radio wave device in the state where it stuck. Dielectric thin film 5 is surrounding the surface of styrene foam structure 4, and is formed thinly enough compared with high hardness and a wavelength.

Since it is constituted in this way, the circumference of antenna 2 arranged inside housing for protection 1 and antenna support rod 3 is held at the state where it stuck with styrene foam. Therefore, mechanical modification of the bend produced from external factors, such as a rainstorm, or the sudden phenomenon under measurement does not occur.

Since styrene foam structure 4 is using styrene foam with a high foaming rate, it holds sufficient strength also to the static load concerning antenna 2 or antenna support rod 3. Since the EFRETHANE with high hardness was used for dielectric thin film 5, styrene foam structure 4 has sufficient strength and weather resistance also to the local load concerning antenna 2 or antenna support rod 3.

Subsequently, the inventor etc. conducted various experiments about the relation between the foaming rate of styrene foam, and the thickness (it is only hereafter described as the thickness of the paint film of a EFRETHANE) of the paint film which coated the EFRETHANE, in order to acquire the optimal value which can make as small as possible loss of the radio wave which enters into antenna 2. Styrene foam structure 4 used styrene foam with a high foaming rate, and the EFRETHANE was used for dielectric thin film 5.

First, in order to check the validity of the EFRETHANE used with dielectric thin film 5, the inventor etc. measured, respectively about the case where the case where the conventional FRP is used as dielectric thin film 5, and a EFRETHANE are used. The result is a characteristic figure showing in FIG. 2. In FIG. 2, an vertical axis is loss [dB] of the radio wave which enters into antenna 2, and a horizontal axis is frequency. As measuring frequency, it measured about three, 76 GHz, 85 GHz, and 94 GHz, in a millimeter wave band. In FIG. 2, —O—O— shows the result of a measurement at the time of using a EFRETHANE, and -□-□- shows the result of a measurement at the time of using the conventional FPR, respectively.

When the result of a measurement shown in FIG. 2 is seen, in the case of housing for protection 1 which uses a EFRETHANE, there is little loss of a radio wave in all three frequency. However, in the case of the housing for protection which uses the conventional FRP, in the high frequency of 85 GHz and 94 GHz, loss of a radio wave is increasing remarkably. The validity of the EFRETHANE has been checked from this result of a measurement.

In order that [subsequently,] an inventor etc. may acquire the optimal value (optimal value of a foaming rate, and optimal value of the thickness of a paint film) which can make small loss of the radio wave which enters into antenna 2 The foaming rate of styrene foam and the thickness of the paint film of dielectric thin film 5 were changed, respectively, and were measured about loss of the radio wave. Styrene foam structure 4 used styrene foam with a high foaming rate. The result is a characteristic figure showing in FIGS. 3-5, FIGS. 6-9, respectively.

FIGS. 3-5 show the result of measuring the relation between thickness (mm) of the paint film of dielectric thin film 5, and loss (dB) of a radio wave. The vertical axis shows loss (dB) of the radio wave which enters into antenna 2. The horizontal axis shows the thickness (mm) of the paint film of a EFRETHANE. The foaming rate of the styrene foam which constitutes styrene foam structure 4 used the styrene foam which is 20 times, 30 times, and 40 times, respectively as a sample for an examination. A parameter is frequency. FIG. 3 shows the result of a measurement at the time of using the sample whose foaming rate is 20. FIG. 4 shows the result of a measurement at the time of using the sample whose foaming rate is 30. FIG. 5 shows the result of a measurement at the time of using the sample whose foaming rate is 40.

FIGS. 6-9 show the result of measuring the relation between foaming rate of the styrene foam, and loss (dB) of a radio wave. The vertical axis shows loss (dB) of the radio wave which enters into antenna 2. The horizontal axis shows the foaming rate (multiplying factor) of styrene foam. The EFRETHANE is being used for dielectric thin film 5. The thickness of the paint film of a EFRETHANE used the EFRETHANE which are 0.5 mm, 1 mm, 2 mm, and 3 mm, respectively as a sample for an examination. A parameter is frequency. FIG. 6 shows the result of a measurement in case the thickness of a paint film is 0.5 mm. FIG. 7 shows the result of a measurement in case the thickness of a paint film is 1 mm. FIG. 8 shows the result of a measurement in case the thickness of a paint film is 2 mm. FIG. 9 shows the result of a measurement in case the thickness of a paint film is 3 mm.

As shown in FIGS. 3-5 and FIGS. 6-9, the frequency to measure was measured about three, 76 GHz, 85 GHz, and 94 GHz, in a millimeter wave band.

-<>-<>- shows the result of a measurement in 76 GHz.

-□-□- shows the result of a measurement in 85 GHz.

-Δ-Δ- shows the result of a measurement in 94 GHz.

As shown in FIGS. 3-5, the thickness of the paint film of a EFRETHANE measured about four points, 0.5 mm, 1 mm, 2 mm, and 3 mm. As shown in FIGS. 6-9, the foaming rate of styrene foam 4 measured by three points, 20 times, 30 times, and 40 times.

Each result of a measurement is examined based on FIGS. 3-5 and FIGS. 6-9. First, the thickness of the paint film of dielectric thin film 5 is examined. When the thickness of a paint film is 3 mm, loss of a radio wave is large on the high frequency of 85 GHz and 94 GHz. When the thickness of a paint film is 2 mm or less, loss of a radio wave decreases. Therefore, the result that the thickness of a paint film was the optimal value when it is 2 mm or less was obtained. And when the thickness of the paint film of dielectric thin film 5 is 2 mm or less, the foaming rate of the styrene foam which has a high foaming rate used by styrene foam structure 4 has small loss of a radio wave in all the magnifications. Therefore, the result that the foaming rate of styrene foam should just be 20 or more times was obtained.

EMBODIMENT 2

The 2nd embodiment of this invention is an embodiment at the time of omitting antenna support rod 3 which supports antenna 2 in the 1st embodiment. Hereafter, the 2nd embodiment of this invention is explained in detail based on FIG. 10. About the same portion as the 1st embodiment, the explanation is omitted using the same name and the same number. FIG. 10 is a mimetic diagram in which showing the 2nd embodiment of this invention and showing housing for protection 11, and the radio wave device arranged to that inside.

As shown in FIG. 10, the radio wave device arranged in housing for protection 11 is constituted by feeder 12 for supplying electric power to antenna 2 and this antenna 2. Feeder 12 is connected to antenna 2 and electric power is supplied to antenna 2 via this feeder 12.

The circumference of antenna 2 and feeder 12 is enclosed with the state where it stuck with the styrene foam which has the specific inductive capacity which is transparent to a radio wave, like Embodiment 1. This forms styrene foam structure 4. The surface of this styrene foam structure 4 is surrounded with dielectric thin film 5. Housing for protection 11 is constituted by styrene foam structure 4 and dielectric thin film 5. Therefore, antenna 2 is supported without the antenna support rod by styrene foam structure 4. Antenna 2 is protected from the external factor etc. by styrene foam structure 4 and dielectric thin film 5 like Embodiment 1.

Since it is constituted in this way, antenna 2 and feeder 12 as a radio wave device which are arranged inside are held at the state where the circumference stuck with styrene foam. Therefore, in an electric appliance, mechanical modification of the bend produced from external factors, such as a rainstorm, or the sudden phenomenon under measurement does not occur. When the local load to a bar antenna like a dipole antenna is added, high strength can be maintained and weather resistance can be maintained further. An antenna support rod can be omitted, the number of parts decreases so much, structure is simplified, and reflection of a radio wave with an antenna support rod can also be prevented.

EMBODIMENT 3

The 3rd embodiment of this invention is an embodiment at the time of using spherical dielectrics electromagnetic lens 22 as a radio wave device arranged in housing for protection 21. Hereafter, the 3rd embodiment of this invention is explained in detail based on FIG. 11. About the same portion as the 1st embodiment and the 2nd embodiment, the same name and the same numerals are attached and the explanation is omitted.

FIG. 11 is a mimetic diagram in which showing the 3rd embodiment of this invention, and showing the radio wave device arranged inside housing for protection 21 and this housing for protection 21.

In FIG. 11, the radio wave device arranged in housing for protection 21 is constituted by spherical dielectrics electromagnetic lens 22 and spherical radio wave reflector 23.

The circumference of dielectrics electromagnetic lens 22 which constitutes a radio wave device is enclosed with the state where it stuck with the styrene foam which has the specific inductive capacity which is transparent to a radio wave, like the case of Embodiment 1 and Embodiment 2. This styrene foam structure 4 is formed in the globular form, and it is formed so that this spherical radius may become equal to the focal length of dielectrics electromagnetic lens 22. That is, styrene foam structure 4 is formed so that the radio wave which entered into dielectrics electromagnetic lens 22 via styrene foam structure 4 may connect a focus to the surface of styrene foam structure 4. Radio wave reflector 23 which reflects a radio wave is formed in the surface of styrene foam structure 4. All the surfaces of styrene foam structure 4 and radio wave reflector 23 are surrounded with dielectric thin film 5, and housing for protection 21 is constituted.

Therefore, the radio wave which entered into dielectrics electromagnetic lens 22 via styrene foam structure 4 is reflected by radio wave reflector 23 arranged on the styrene foam structure 4 surface. This reflected wave is reflected in the same direction as an incident wave. Dielectrics electromagnetic lens 22 and radio wave reflector 23 are protected from the external factor etc. like Embodiment 1 by housing for protection 21. Housing for protection 21 is constituted by styrene foam structure 4 and dielectric thin film 5.

Since it is constituted in this way, styrene foam structure 4 and dielectrics electromagnetic lens 22 can be used as the Luneberg lens which has the same characteristic as all the directions. Therefore, the radio wave reflecting device which can reflect the radio wave which entered in the same direction is obtained.

EMBODIMENT 4

In the 3rd embodiment, the 4th embodiment of this invention forms the radio wave receive section in the surface of styrene foam structure 4 instead of forming radio wave reflector 23 in the surface of styrene foam structure 4. The radio wave receive section receives with spherical dielectrics electromagnetic lens 22. Hereafter, the 4th embodiment of this invention is explained in detail based on FIG. 12. About the same portion as the 1st embodiment, the 2nd embodiment, and the 3rd embodiment, the same name and the same numerals are attached and the explanation is omitted.

FIG. 12 is a mimetic diagram in which showing the 4th embodiment of this invention and showing the radio wave device arranged inside housing for protection 31, and this housing for protection 31.

In FIG. 12, the radio wave device arranged in housing for protection 31 is constituted by spherical dielectrics electromagnetic lens 22, radio wave receive section 32 which mentions later, and feeder 33 like Embodiment 3.

The circumference of dielectrics electromagnetic lens 22 which constitutes a radio wave device is enclosed with the state where it stuck with the styrene foam which has the specific inductive capacity which is transparent to a radio wave, like Embodiment 1 and Embodiment 2. This styrene foam structure 4 is formed in the globular form, and it is formed so that the spherical radius may become equal to the focal length of dielectrics electromagnetic lens 22. That is, styrene foam structure 4 is formed so that the radio wave which entered into dielectrics electromagnetic lens 22 via styrene foam structure 4 may connect a focus to the surface of styrene foam structure 4.

Radio wave receive section 32 which receives the radio wave which enters into dielectrics electromagnetic lens 22 forms in the surface of styrene foam structure 4. And the radio wave which entered is formed so that a focus may be connected to this surface. Feeder 33 is connected to radio wave receive section 32, and electric power is supplied to radio wave receive section 32 via this feeder 33. This styrene foam structure 4, radio wave receive section 32, and feeder 33 are surrounded with dielectric thin film 5. Therefore, a radio wave device is constituted by dielectrics electromagnetic lens 22, radio wave receive section 32 and feeder 33, and housing for protection 31 is constituted by styrene foam structure 4 and dielectric thin film 5. The radio wave device arranged inside housing for protection 31 is protected from the external factor etc.

Since it is constituted in this way, styrene foam structure 4 and dielectrics electromagnetic lens 22 can be used like Embodiment 3 as a Luneberg lens which has the same characteristic as all the directions. And the radio wave which entered is receivable with radio wave receive section 32.

This invention is not limited to each above-mentioned embodiment. For example, the housing for protection uses the styrene foam which has the specific inductive capacity which is transparent to a radio wave. The circumference of a radio wave device makes an opening intervene, and forms styrene foam structure. The surface of this styrene foam structure is high hardness, and is formed in the structure surrounded with the dielectric thin film formed thinly enough compared with the wavelength. A cave will be formed in the inside of the housing for protection if it forms in such a structure. Therefore, it can use also for the antenna of form which the radio wave device arranged inside the housing for protection rotates like the parabolic antenna of a radar.

INDUSTRIAL APPLICABILITY

The housing for protection of the radio wave apparatus by this invention can be used irrespective of indoor and the outdoors. Since it can form in any shape, it can form in shape which does not highlight that it is a radome. Therefore, it can be used so that it may not be remarkable at a place with much public notice.

The invention claimed is:

1. In a radio wave apparatus which has a housing for protection which protects the radio wave device arranged inside, and said radio wave device arranged inside the housing for protection, said radio wave apparatus comprising: said housing for protection consists of a styrene foam structure and a dielectric thin film, forming said styrene foam structure in the circumference of said radio wave device with styrene foam, said styrene foam has the specific inductive capacity which is transparent to a radio wave, said dielectric thin film surrounds the surface of said styrene foam structure, is high hardness and forms thin enough compared with a wavelength, said radio wave device is a spherical dielectric electromagnetic lens, said styrene foam structure covers the surface of said dielectric electromagnetic lens, having a radius equal to the focal length of said dielectric lens, and wherein said styrene foam is stuck to the circumference of said radio wave device enclosed therein, wherein said dielectric thin film is a dielectric paint film of coated resin, and said dielectric paint film is a paint film of non-solvent urethane resin (EFRETHANE).

2. In radio wave apparatus as claimed in claim 1, wherein the dielectric thin film is a dielectric paint film of coated resin, said dielectric paint film is a paint film of non-solvent urethane resin (EFRETHANE), the foaming rate of said styrene foam structure is 20 or more times, and the thickness of said dielectrics paint film is 2mm or less.

3. In radio wave apparatus as claimed in claim 1, wherein the dielectric thin film is a dielectric paint film of coated resin, said dielectric paint film is a paint film of non-solvent urethane resin (EFRETHANE), urethane foam is used instead of said styrene foam structure.

4. In the radio wave apparatus which has the housing for protection which protects the radio wave device arranged inside, and said radio wave device arranged inside the housing for protection, said radio wave apparatus comprising: said housing for protection consists of styrene foam structure and a dielectric thin film, forming said styrene foam structure in the circumference of said radio wave device with styrene foam, which styrene foam has the specific inductive capacity which is transparent to radio wave, said dielectric thin film surrounds the surface of said styrene foam structure, is high hardness and thin enough compared with a wavelength, said radio wave device is a spherical dielectric electromagnetic lens, said styrene foam structure covers the surface of said dielectrics electromagnetic lens, having a radius equal to the focal length of said dielectric lens, and wherein said styrene foam is stuck to the circumference of said radio wave device, encloses said device, the radio wave reflector which reflects a radio wave in the surface of said styrene foam structure is formed, wherein said dielectric thin film is a dielectric paint film of coated resin, and said paint film is a paint film of non-solvent urethane resin (EFRETHANE).

5. In radio wave apparatus as claimed in claim 4, the dielectric thin film is a dielectric paint film of coated resin, said dielectric paint film is a paint film of non-solvent urethane resin (EFRETHANE), the foaming rate of said styrene foam structure is 20 or more times, and the thickness of said dielectric paint film is 2mm or less.

6. In radio wave apparatus as claimed in claim 4, wherein the dielectric thin film is a dielectric paint film of coated resin, said dielectric paint film is a paint film of non-solvent urethane resin (EFRETHANE), urethane foam is used instead of said styrene foam structure.

7. In a radio wave apparatus which has a housing for protection which protects the radio wave device arranged inside, and said radio wave device arranged inside this housing for protection, said radio wave apparatus comprising: said housing for protection consists of styrene foam structure and a dielectric thin film, forming said styrene foam structure in the circumference of said radio wave device with styrene foam, the styrene foam has the specific inductive capacity which is transparent to a radio wave, said dielectric thin film surrounds the surface of said styrene foam structure, is high hardness and forms thinly enough compared with a wavelength, said radio wave device is a spherical dielectric electromagnetic lens, said styrene foam structure covers the surface of said dielectric electromagnetic lens, having a radius equal to the focal length of said dielectric lens, and where said styrene foam is stuck to the circumference of said radio wave device, and encloses said device, the radio wave receive section which receives with said spherical dielectric electromagnetic lens is formed in the surface of said styrene foam structure, said radio wherein said dielectric thin film is a dielectric paint film of coated resin, and said dielectric paint film is a paint film of non-solvent urethane resin (EFRETHANE).

8. In radio wave apparatus as claimed in claim 7, wherein the dielectric thin film is a dielectric paint film of coated resin, said dielectric paint film is a paint film of non-solvent urethane resin (EFRETHANE), the foaming rate of said styrene foam structure is 20 or more times, and the thickness of said dielectric paint film is 2mm or less.

9. In radio wave apparatus as claimed in claim 7, wherein the dielectric thin film is a dielectric paint film of coated resin, said dielectric paint film is a paint film of non-solvent urethane resin (EFRETHANE), urethane foam is used instead of said styrene foam structure.

10. In the radio wave apparatus which has a housing for protection which protects the radio wave device arranged inside, and said radio wave device arranged inside said housing for protection, said radio wave apparatus comprising: said housing for protection consists of styrene foam structure and a dielectric thin film, forming said styrene foam structure in the circumference of said radio wave device with styrene foam, said styrene foam has the specific inductive capacity which is transparent to a radio wave, said dielectric thin film surrounds the surface of said styrene foam structure, is high hardness and forms thinly enough compared with a wavelength, said dielectric thin film is a dielectric paint film of coated resin, a foaming rate of said styrene foam of said styrene foam structure is 20 or more times, the thickness of said dielectric paint film is 2mm or less, wherein the dielectric paint film is a paint film of non-solvent urethane resin (EFRETHANE).

11. In radio wave apparatus as claimed in claim 10, wherein said dielectric paint film is a paint film of non-solvent urethane resin (EFRETHANE), and urethane foam is used instead of said styrene foam of said styrene foam structure.

12. In the radio wave apparatus given which has a housing for protection which protects the radio wave device arranged inside, and said radio wave device arranged inside said housing for protection, said radio wave apparatus comprising: the housing for protection consists of styrene foam structure and a dielectric thin film, forming said styrene foam structure in the circumference of said radio wave device with styrene foam, said styrene foam has the specific inductive capacity which is transparent to a radio wave, said dielectric thin film surrounds the surface of said styrene foam structure, is high hardness and forms thinly enough compared with a wavelength, said styrene foam structure is enclosed where said styrene foam is stuck to the circumference of said radio wave device, said dielectric thin film is a dielectric paint film of coated resin, the foaming rate of said styrene foam of said styrene foam structure is 20 or more times, the thickness of said dielectric paint film is 2mm or less, wherein said dielectric paint film is a paint film of non-solvent urethane resin (EFRETHANE).

13. In radio wave apparatus as claimed in claim 12, wherein the dielectric paint film is a paint film of non-solvent urethane resin (EFRETHANE), and urethane foam is used instead of said styrene foam of said styrene foam structure.

14. In the radio wave apparatus which has the housing for protection which protects the radio wave device arranged inside, and said radio wave device arranged inside said housing for protection, said radio wave apparatus comprising: said housing for protection consists of styrene foam structure and a dielectric thin film, forming said styrene foam structure in the circumference of said radio wave device with styrene foam, this styrene foam has the specific inductive capacity which is transparent to a radio wave, said dielectric thin film surrounds the surface of said styrene foam structure, is high hardness and forms thinly enough compared with a wavelength, said radio wave device arranged inside said housing for protection is an antenna, said dielectric thin film is a dielectric paint film of coated resin, the foaming rate of said styrene foam of said styrene foam structure is 20 or more times, the thickness of said dielectric paint film is 2mm or less, wherein the dielectrics paint film is a paint film of non-solvent urethane resin (EFRETHANE).

15. In radio wave apparatus as claimed in claim 14, wherein the dielectric paint film is a paint film of non-solvent urethane resin (EFRETHANE), and urethane foam is used instead of said styrene foam of said styrene foam structure.

16. In the radio wave apparatus given which has the housing for protection which protects the radio wave device arranged inside, and said radio wave device arranged inside this housing for protection, said radio wave apparatus comprising: said housing for protection consists of styrene foam structure and a dielectric thin film, forming said styrene foam structure in the circumference of said radio wave device with styrene foam, said styrene foam has the specific inductive capacity which is transparent to a radio wave, said dielectric thin film surrounds the surface of said styrene foam structure, is high hardness and forms thinly enough compared with a wavelength, said styrene foam structure is enclosed where said styrene foam is stuck to the circumference of said radio wave device, said radio wave device arranged inside said housing for protection is an antenna, said dielectric thin film is a dielectric paint film of coated resin, the foaming rate of said styrene foam of said styrene foam structure is 20 or more times, the thickness of said dielectric paint film is 2mm or less, wherein the dielectric paint film is a paint film of non-solvent urethane resin (EFRETHANE).

17. In radio wave apparatus as claimed in claim 16, wherein the dielectric paint film is a paint film of non-solvent urethane resin (EFRETHANE), and urethane foam is used instead of said styrene foam of said styrene foam structure.

18. In the radio wave apparatus which has the housing for protection which protects the radio wave device arranged inside, and said radio wave device arranged inside said housing for protection, said radio wave apparatus comprising: said housing for protection consists of styrene foam structure and a dielectric thin film, forming said styrene foam structure in the circumference of said radio wave device with styrene foam, said styrene foam has the specific inductive capacity which is transparent to a radio wave, said dielectric thin film surrounds the surface of said styrene foam structure, is high hardness and forms thinly enough compared with a wavelength, said dielectric thin film is a dielectric paint film of coated resin, and said dielectric paint film is a paint film of non-solvent urethane resin (EFRETHANE).

19. In radio wave apparatus as claimed in claim 18, wherein urethane foam is used instead of said styrene foam structure.

20. In the radio wave apparatus which has the housing for protection which protects the radio wave device arranged inside, and said radio wave device arranged inside said housing for protection, said radio wave apparatus comprising: said housing for protection consists of styrene foam structure and a dielectric thin film, forming said styrene foam structure in the circumference of said radio wave device with styrene foam, said styrene foam has the specific inductive capacity which is transparent to a radio wave, said dielectric thin film surrounds the surface of said styrene foam structure, is high hardness and forms thinly enough compared with a wavelength, said styrene foam structure is enclosed where said styrene foam is stuck to the circumference of said radio wave device, said dielectric thin film is a dielectric paint film of coated resin, and said dielectric paint film is a paint film of non-solvent urethane resin (EFRETHANE).

21. In radio wave apparatus as claimed in claim 20, wherein urethane foam is used instead of said styrene foam structure.

22. In the radio wave apparatus which has the housing for protection which protects the radio wave device arranged inside, and said radio wave device arranged inside said housing for protection, said radio wave apparatus comprising: said housing for protection consists of styrene foam structure and a dielectric thin film, forming said styrene foam structure in the circumference of said radio wave device with styrene foam, said styrene foam has the specific inductive capacity which is transparent to a radio wave, said dielectric thin film surrounds the surface of said styrene foam structure, is high hardness and forms thinly enough compared with a wavelength, said radio wave device arranged inside said housing for protection is an antenna, said dielectric thin film is a dielectric paint film which coated resin, and this dielectric paint film is a paint film of non-solvent urethane resin (EFRETHANE).

23. In radio wave apparatus as claimed in claim 22, wherein urethane foam is used instead of said styrene foam structure.

24. In the radio wave apparatus which has the housing for protection which protects the radio wave device arranged inside, and said radio wave device arranged inside said housing for protection, said radio wave apparatus comprising: said housing for protection consists of styrene foam structure and a dielectric thin film, forming said styrene foam structure in the circumference of said radio wave device with styrene foam, said styrene foam has the specific inductive capacity which is transparent to a radio wave, said dielectric thin film surrounds the surface of said styrene foam structure, is high hardness and forms thinly enough compared with a wavelength, said styrene foam structure is enclosed where said styrene foam is stuck to the circumference of said radio wave device, said radio wave device arranged inside said housing for protection is an antenna, said dielectric thin film is a dielectric paint film of coated resin, and said dielectric paint film is a paint film of non-solvent urethane resin (EFRETHANE).

25. In radio wave apparatus as claimed in claim 24, wherein urethane foam is used instead of said styrene foam structure.

* * * * *